United States Patent [19]

Tibbitts

[11] 4,016,661

[45] Apr. 12, 1977

[54] WESTERN-TYPE BOOT PAC WITH INSULATED WATERPROOF CONSTRUCTION

[76] Inventor: Allen Ben Tibbitts, Box 162, Teton, Idaho 83451

[22] Filed: Nov. 5, 1975

[21] Appl. No.: 629,619

[52] U.S. Cl. ..... 36/4

[51] Int. Cl.[2] ..... A43B 1/10

[58] Field of Search ..... 36/4, 7, 3, 83, 87, 36/7.1, 45

[56] References Cited

UNITED STATES PATENTS

| | | | |
|---|---|---|---|
| 1,947,173 | 2/1934 | Riley | 36/4 |
| 2,426,211 | 8/1947 | Heckman | 36/4 |
| 2,724,676 | 11/1955 | Randall et al. | 36/4 |
| 3,319,360 | 5/1967 | Nadler | 36/4 |

*Primary Examiner*—Patrick D. Lawson
*Attorney, Agent, or Firm*—Clarence A. O'Brien; Harvey B. Jacobson

[57] ABSTRACT

A western-type boot pac with an insulated waterproof construction in the form of a laminated structure including an outer wall of waterproof material such as rubber, an inner layer of fabric-like material such as cotton duck and an intermediate layer of foam plastic insulating material. The boot pac includes a riding toe, riding heel and steel shank or arch in order to provide adequate support in the stirrup as well as adequate protection against sub-zero winter temperatures.

2 Claims, 2 Drawing Figures

WESTERN-TYPE BOOT PAC WITH INSULATED WATERPROOF CONSTRUCTION

BACKGROUND OF THE INVENTION

1. Field of the Invention

This invention relates to a western-type boot pac, and more particularly to a western-type boot pac having an insulated waterproof construction.

2. Description of the Prior Art

The conventional and well-known western boot having a high steel arch, riding toe and heel to facilitate retention and support of the boot in a stirrup of a saddle functions in a satisfactory manner but has a serious deficiency when used in colder areas, in that the boot does not provide protection against extreme cold and inclement weather. While insulated waterproof boot pacs are generally known, such as the conventional snow-pac, the known boot pacs are constructed in a manner which is quite bulky and in some instances are provided with only a soft and flexible sole in the arch supporting area. Even if the conventional boot pacs have some type of steel shank in the arch support area, they cannot be easily positioned in stirrups, do not provide adequate support in the arch area when engaged with a stirrup, are not properly retained in a stirrup and are not conducive to the style and aesthetic ornamentation and general appearance universally sought in the western boot.

I am aware of the following patents that may be pertinent to the invention: U.S. Des. Pat. No. 166,837 — May 20, 1952 U.S. Des. Pat. No. 190,222 — May 2, 1961 U.S. Pat. No. 1,076,845 — Oct. 18, 1913 U.S. Pat. No. 1,642,050 — Sep. 13, 1927 U.S. Pat. No. 2,132,066 — Oct. 4, 1938.

SUMMARY OF THE INVENTION

It is an object of the present invention to provide a western-type boot pac having an insulated waterproof construction.

It is another object of the present invention to provide a western-type boot pac of improved construction whereby the boot pac is functionally enhanced while retaining completely the aesthetic appearance of a western-type boot.

It is yet another object of the present invention to provide a western-type boot pac which is insulated and waterproof, but is sufficiently compact and shaped to insure good stirrup fit.

These and other objects are achieved according to the present invention by providing a western-type boot pac in the form of a western-type boot in which the foot and leg enclosing portions include walls having an outer layer constructed from rubber or the like, an inner layer constructed from a fabric-like material, and an intermediate layer of insulating material such as resilient foam plastic, rubber, or the like.

The foot enclosing portion of the boot pac includes a riding toe, riding heel and a high arch reinforced by the usual steel shank for proper retention in a stirrup and for adequate support when downward force is exerted on the stirrup by the wearer of the boot pacs. The upper is preferably split along the upper portion and into the lower portion toward the toe of the boot pac for facilitating placement in and removal of a wearer's foot from the boot pac with suitable closure means being provided for the split such as a waterproof bellows tongue and buckles or lacing.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
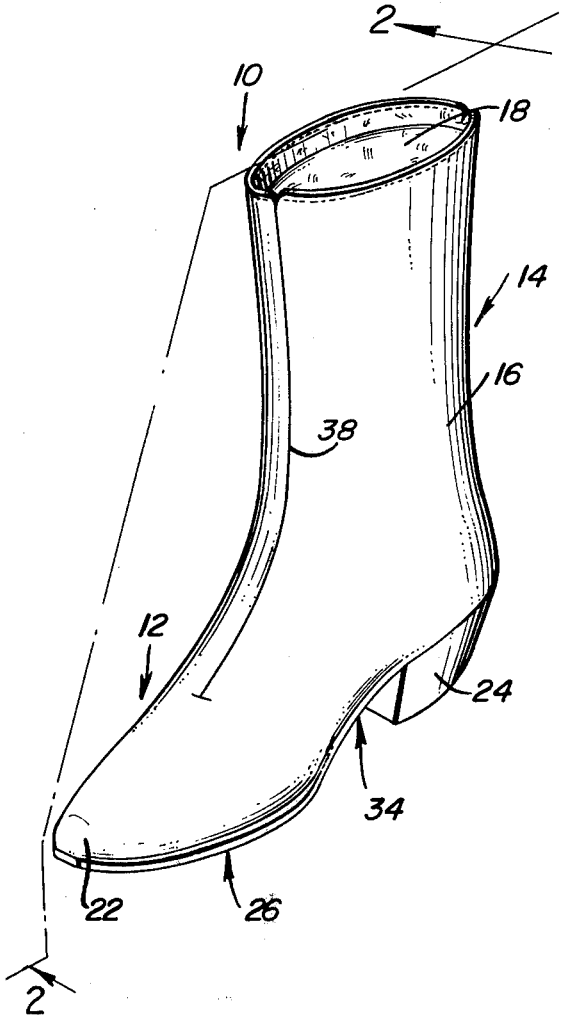
FIG. 1 is a perspective view showing a boot pac according to the present invention.
Figure 2:
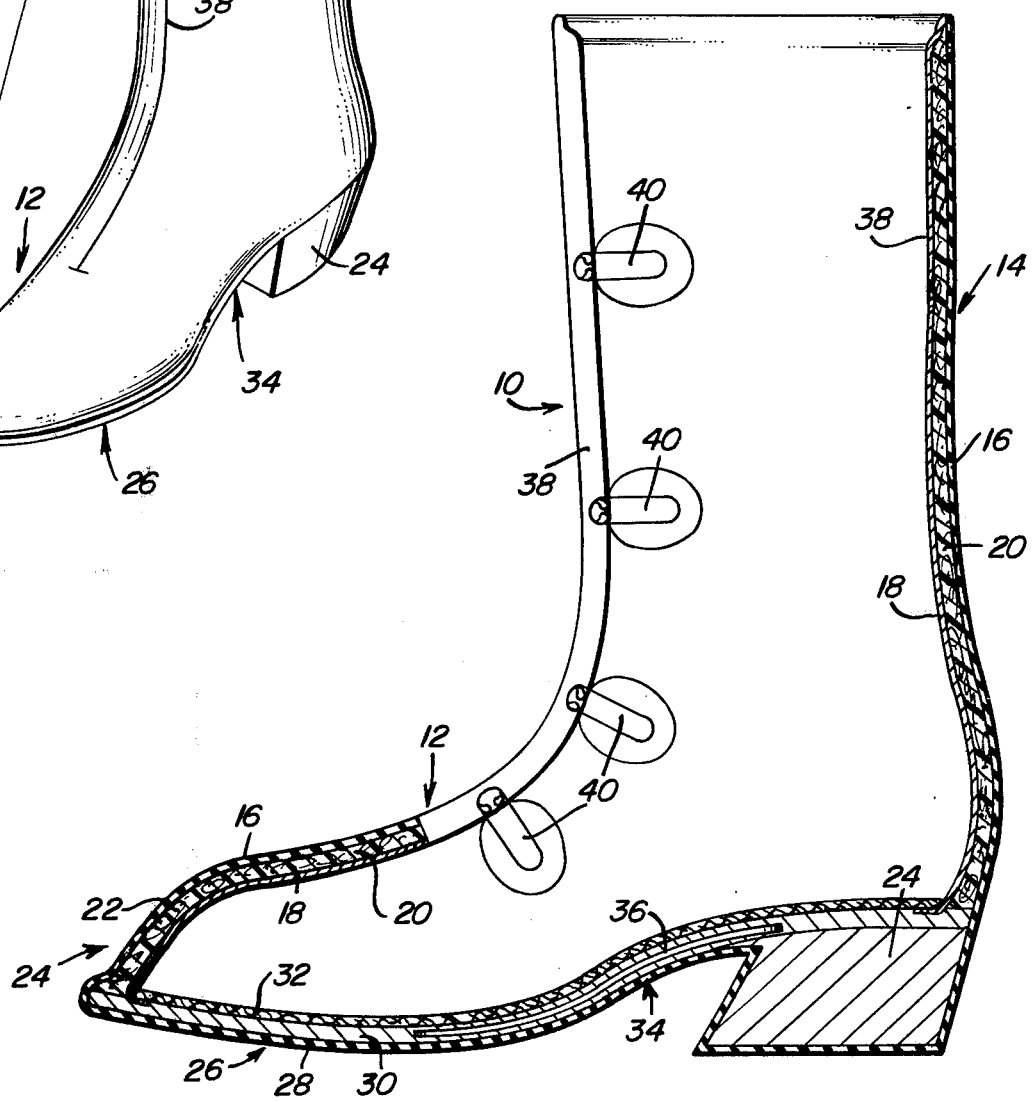
FIG. 2 is a sectional view taken generally along the line 2—2 of FIG. 1, but drawn to a larger scale.

The western-type boot pac of the present invention is designated by numeral 10 including an insulated waterproof construction in the shape and configuration of a western-type boot. The boot pac 10 includes a foot enclosing portion 12 and a leg enclosing portion 14 of integral construction and defined by a laminated wall having an outer layer 16 constructed from waterproof, flexible, resilient material such as rubber, or the like, an inner layer 18 constructed from flexible, absorbent, warm feeling fabric material such as cotton ducking or other wear resistant material, and an intermediate layer 20 of flexible, resilient insulating material such as a thin layer of a suitable, known foamed material such as polyurethane.

The foot enclosing portion 12 includes a riding toe 22, and a riding heel 24 with a sole 26 extending therebetween. The sole 26 includes an outer sole 28 of flexible, resilient waterproof material such as rubber, or the like, which also covers the heel, a midsole 30 of leather, felt, or the like, and an inner sole 32 of cushioned fabric or the like. The sole 26 includes a high arch supporting area 34 adjacent the heel with a steel shank 36 embedded therein in a conventional manner. The rigidity of the shank and midsole 30 maintain the shape of the boot pac.

The leg enclosing portion 14 and a portion of the foot enclosing portion 12 includes a split 38 formed therein to enable the boot pac 10 to be easily donned or removed and lacing tabs 40 are provided adjacent split 38 to enable lacing in a known manner.

As will be appreciated from the above description and from the drawings, a boot pac according to the present invention provides an insulated, waterproof construction which retains the aesthetic characteristics of the conventional western-type boot and also retains the functions of the western style cowboy boot, since the boot pac can be easily inserted into and retained in the stirrup and will provide adequate support for the arch of the foot when pressure is exerted downwardly on the stirrup. In addition, the waterproof insulated construction provides adequate protection against subzero temperatures and rain, snow or wet conditions thus satisfying the needs of ranchers, feedlot operators, livestock sale yard personnel, hunters, cutter racers as well as cowboys engaged in various outdoor riding activities. If desired, a medium weight felt liner may be provided to provide additional insulation. Such a liner will be shaped in the same configuration as the interior of the western-type boot pac.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An article of footwear for use by a wearer engaged in outdoor activities during inclement or very cold weather conditions and requiring periods of horseback riding in which the wearer must place his feet in saddle stirrups and exert downward pressure on the stirrups in the arch area of each foot in order to maintain his position in the saddle, said article of footwear including a foot enclosing portion and a leg enclosing portion for enclosing the foot and the lower portion of the leg of the wearer, said foot enclosing portion including a riding toe of tapering and pointed construction simulative of a western style riding toe to facilitate insertion of the foot enclosing portion into a stirrup and to facilitate removal therefrom without accidental entanglement, a sole extending rearwardly from the riding toe and including a high arch supporting area immediately in front of the breast of a high riding heel to facilitate retention of a stirrup in the high arch supporting area, a rigid shank in said high arch supporting area with the forward end of the shank terminating at the forward end of the high arch supporting area and substantially rearwardly of the riding toe whereby the forward portion of the foot enclosing portion remains flexible, said sole, heel, high arch supporting area, riding toe and the remainder of the foot enclosing portion and the leg enclosing portion including an outer layer of flexible, resilient, waterproof material of unitary construction and an inner layer of fabric material, said leg enclosing portion and the portion of the foot enclosing portion above the sole including an intermediate layer of flexible, resilient, foam cellular insulating material, said sole including an intermediate layer in the form of a shape sustaining midsole having the rigid shank mounted fixedly therein to distribute forces exerted on the stirrup over a large surface area of the bottom of the foot of a wearer.

2. The article of footwear as defined in claim 1 wherein said outer layer is rubber, said insulating material is foam plastic and all of said layers are laminated to form an integral structure, said riding heel including a downwardly and forwardly inclined breast surface and downwardly and inwardly inclined peripheral side and rear surfaces, said midsole having its peripheral edge extending into underlying relation to the bottom edge of the intermediate layer of insulating material.

* * * * *